US006736623B2

(12) United States Patent
Li et al.

(10) Patent No.: US 6,736,623 B2
(45) Date of Patent: May 18, 2004

(54) GAS COMPRESSOR HAVING A PRESS-FIXED OIL SEPARATION FILTER

(75) Inventors: Zegun Li, Chiba (JP); Takeshi Nonaka, Chiba (JP)

(73) Assignee: Calsonic Compressors Manufacturing Inc., Chiba (JP)

( * ) Notice: Subject to any disclaimer, the term of this patent is extended or adjusted under 35 U.S.C. 154(b) by 0 days.

(21) Appl. No.: 10/267,367

(22) Filed: Oct. 9, 2002

(65) Prior Publication Data

US 2003/0095885 A1 May 22, 2003

(30) Foreign Application Priority Data

Oct. 15, 2001 (JP) ..... 2001-316887

(51) Int. Cl.[7] ..... F04C 29/02; B01D 39/10; B01D 39/12

(52) U.S. Cl. ..... 418/97; 418/DIG. 1; 55/498; 55/DIG. 17

(58) Field of Search ..... 418/259, DIG. 1, 418/97; 55/498, DIG. 17

(56) References Cited

U.S. PATENT DOCUMENTS 1,892,210 A * 12/1932 Gordon ..... 55/498
3,385,513 A * 5/1968 Kilgore ..... 418/DIG. 1
4,091,638 A * 5/1978 Mitch ..... 418/DIG. 1
4,516,994 A 5/1985 Kocher ..... 55/337
6,082,981 A * 7/2000 Nakajima et al. ..... 418/DIG. 1
6,261,333 B1 7/2001 Dickson ..... 55/385.3

FOREIGN PATENT DOCUMENTS

JP 2-91490 * 3/1990 ..... 418/DIG. 1
JP 9068179 3/1997

* cited by examiner

*Primary Examiner*—John J. Vrablik
(74) *Attorney, Agent, or Firm*—Adams & Wilks

(57) ABSTRACT

To provide a gas compressor in which fretting wear due to vibration of an oil separation filter is prevented to thereby achieve an improvement in durability. A gas compressor is provided with a press-fixing unit for press-fixing end portions of an oil separation filter. As the press-fixing means, for example, it is possible to adopt a construction including an abutment block portion against which the bottom end portion of the oil separation filter abuts, an outer peripheral block portion having a filter accommodating hole into which the oil separation filter is inserted, and a pressurizing plate put over the forward end portion of the oil separation filter and mounted and fixed to the outer peripheral block portion, wherein the forward end portion of the oil separation filter is provided so as to protrude from the filter accommodating hole on the surface of the outer peripheral block portion, and wherein the protruding forward end portion of the oil separation filter is pressurized and bent by the pressurizing plate to undergo elastic deformation.

20 Claims, 6 Drawing Sheets

GAS COMPRESSOR HAVING A PRESS-FIXED OIL SEPARATION FILTER

BACKGROUND OF THE INVENTION

1. Field of the Invention

The present invention relates to a gas compressor for use in a vehicle air conditioning system or the like and, more particularly, aims to prevent fretting wear due to vibration of an oil separation filter contained in an apparatus to thereby achieve an improvement in durability.

2. Description of the Related Art

Conventionally, a gas compressor of this type has, as shown, for example, in FIG. 7, a compression mechanism C in a compressor case 1, and this compression mechanism C sucks in low pressure refrigerant gas in a suction chamber 6 and compresses it before discharging it into a discharge chamber 5 as high pressure refrigerant gas. At this time, the high pressure refrigerant immediately after being discharged from the compression mechanism C contains oil in the mist state filled for the purpose, for example, of lubricating the sliding portion of the compression mechanism portion C, and the oil ingredient in such high pressure refrigerant gas is separated by an oil separator 20 contained in the gas compressor.

The oil separator 20 has an oil separation filter 21 formed by rolling a wire net into a cylinder, and the oil ingredient in the high pressure refrigerant gas is separated when a high speed gas flow of high pressure refrigerant gas strikes upon the wire net constituting the oil separation filter 21 or by the centrifugal force generated when high pressure refrigerant gas whirls inside the oil separation filter 21.

However, in the oil separator 20 of the conventional construction described above, in which a pulsating high speed gas flow incessantly strikes upon the wire net constituting the oil separation filter 21, if the wire net is not supported and fixed in a satisfactory manner, a vibration such as twist is generated in the entire wire net, with the result that the constituent wire materials of the wire net (wires) rub each other, and the wire net and the support member in contact therewith rub each other, resulting in the generation of so-called fretting wear of the wire net to damage the wire net.

The present invention has been made in view of the above problem. It is an object of the present invention to provide a gas compressor in which fretting wear due to vibration of the oil separation filter is prevented to thereby achieve an improvement in durability.

SUMMARY OF THE INVENTION

To achieve the above object, there is provided, in accordance with the present invention, a gas compressor comprising a compression mechanism portion which sucks in, compresses, and discharges refrigerant gas, a discharge chamber for temporarily storing the refrigerant gas discharged from the compression mechanism portion, a discharge passage which communicates the compression mechanism portion with the discharge chamber and which guides the refrigerant gas discharged from the compression mechanism portion to the discharge chamber, an oil separation filter which is arranged in the discharge chamber at the downstream end of the discharge passage and which is formed by shaping a lattice-like member into a cylindrical configuration, pressing means for pressing the end portions of the oil separation filter to elastically deform the oil separation filter sufficiently to suppress vibration thereof during use of the gas compressor, and an oil sump formed at the bottom of the discharge chamber and adapted to store the oil separated by the oil separation filter.

In the present invention, the oil separation filter as a whole is firmly fixed in a pressed state by the pressing force when the pressing means presses the end portions of the oil separation filter.

Here, as the pressing means, it is possible to adopt a construction comprising an abutment block portion against which the bottom end portion of the oil separation filter abuts, an outer peripheral block portion having a filter accommodating hole into which the oil separation filter is inserted, and a pressurizing plate put over the forward end portion of the oil separation filter and mounted and fixed to the outer peripheral block portion, wherein the forward end portion of the oil separation filter is provided so as to protrude from the filter accommodating hole on the surface of the outer peripheral block portion, and wherein the protruding forward end portion of the oil separation filter is pressurized and bent by the pressurizing plate to undergo elastic deformation.

In this construction, the forward end portion of the oil separation filter is pressurized and bent toward the abutment block portion by the pressurizing plate to undergo elastic deformation, and due to this elastic deformation of the oil separation filter, the oil separation filter is strongly pressed against the pressurizing plate, the abutment block, and the outer peripheral block portion and fixed thereto.

It is possible to adopt a construction in which the forward end portion of the oil separation filter is previously bent in a fixed direction by a bending amount smaller than a press-bending amount before being press-bent by the pressurizing plate.

In this construction, the forward end portion of the oil separation filter is press-bent by the pressurizing plate such that all the portions thereof are directed in the same direction, so that the construction proves superior in operability in fixing the bending direction.

Further, it is desirable that the direction in which the forward end portion of the oil separation filter is previously bent be toward the inner side of the filter.

In this construction, the forward end portion of the oil separation filter is press-bent by the pressurizing plate such that it is always directed to the inner side of the filter, so that there is no danger of the bent forward end portion of the oil separation filter being caught between the pressurizing plate and the outer peripheral block, making it possible to correctly mount and fix the pressurizing plate to the outer peripheral block portion.

It is possible to provide in the inner surface of the filter accommodating hole a clearance groove which allows entrance of the forward end portion of the oil separation filter when it is press-bent to the filter outer side.

In this construction, for example, there is no directivity in the bending of the forward end portion of the oil separation filter press-bent by the pressurizing plate, and even when the forward end portion of the oil separation filter is bent so as to be directed to the filter outer side, this press-bent portion enters the clearance groove, so that there is no danger of the bent forward end portion of the oil separation filter being caught between the pressurizing plate and the outer peripheral block, making it possible to correctly mount and fix the pressurizing plate to the outer peripheral block portion.

The oil separation filter may, for example, be formed of a lattice-like member, such as wire net or expanded metal; in particular, in the case of a wire net type oil separation filter, it is desirable to fuse by spot welding the regions where the constituent wire materials of the wire net (wires) intersect each other in order to prevent fretting wear as a result of the constituent wires of the wire net being rubbed against each other.

Further, the spot welding is performed in order to prevent fretting wear mainly due to vibration between the constituent wire materials of the wire net, and, from the viewpoint of the object of this spot welding, it is desirable to increase the number of spot welding points for the region where, for example, the high speed gas flow of high pressure refrigerant gas first strikes directly.

BRIEF DESCRIPTION OF THE DRAWINGS

FIGS. 1A and 1B are section views of an embodiment of the present invention, of which FIG. 1A is a diagram showing the state prior to the fixation of the pressurizing plate by bolts, and FIG. 1B is a diagram showing the stae after the fixation of the pressurizing plate by bolts.

FIGS. 2A and 2B are a perspective views of the oil separator of FIGS. 1A and 1B, of which FIG. 2A is a diagram showing the state prior to the fixation of the pressurizing plate by bolts.

FIGS. 6A and 6B are a perspective views of another embodiment of the present invention, of which FIG. 6A is a diagram showing the state prior to the fixation of the pressurizing plate by caulking, and FIG. 6B is a diagram showing the state after the fixation of the pressurizing plate by caulking.

DESCRIPTION OF THE PREFERRED EMBODIMENT

In the following, an embodiment of the gas compressor of the present invention will be described in detail with reference to FIGS. 1 through 6. The components which are the same as those of the conventional construction will be described with reference to FIGS. 7 and 8.

Figure 7:
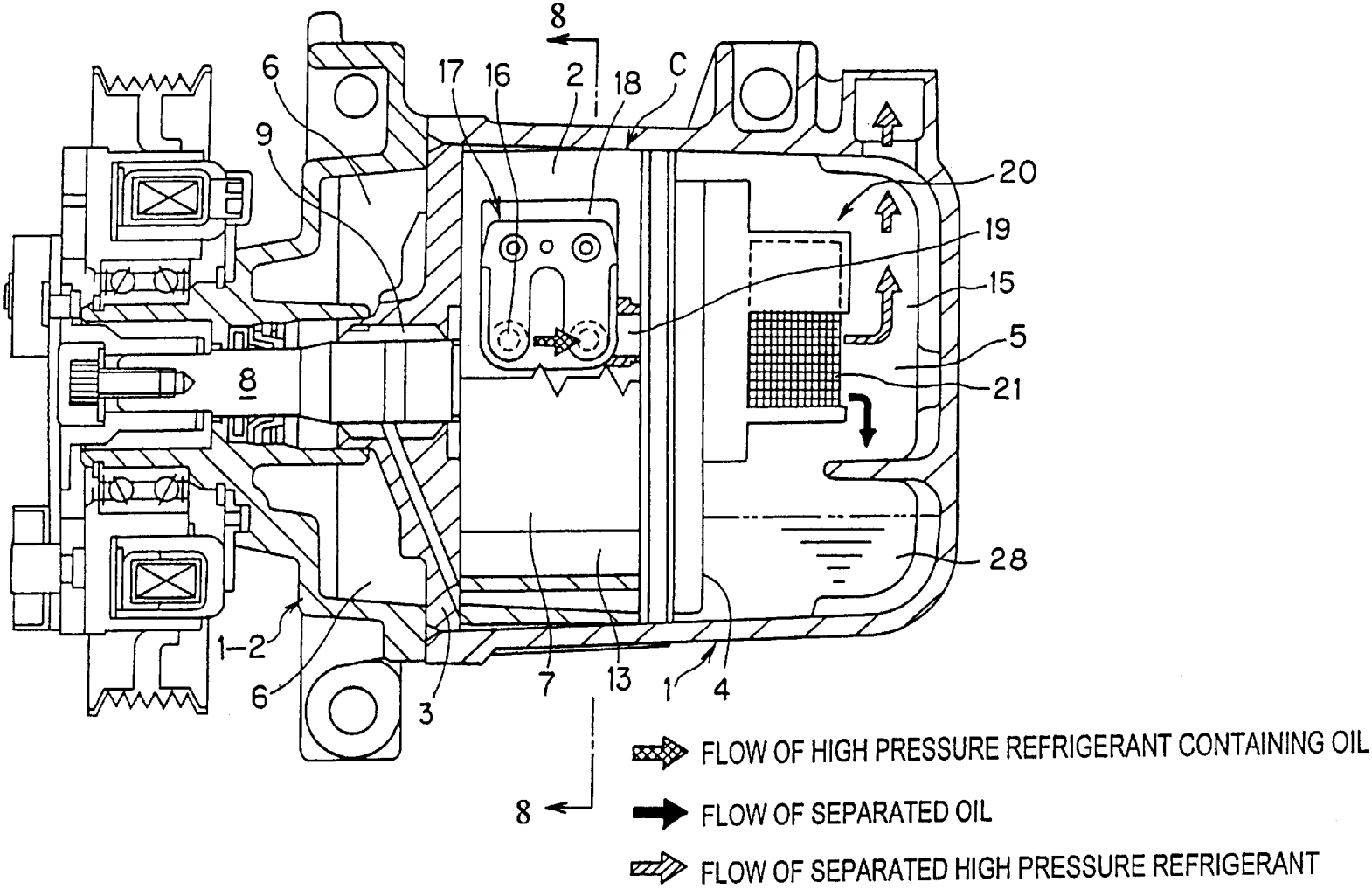
FIG. 7 is an explanatory diagram showing the basic construction of a gas compressor.

As shown in FIG. 7, the gas compressor of this embodiment has a construction in which a compression mechanism portion C is accommodated in a one-end-open-type compressor case 1, and, between this compression mechanism portion C and a front head 1-2 mounted to the open end of the compressor case 1, there is defined a low pressure suction chamber 6 (low pressure chamber); further, between the inner, closed end of the compressor case 1 and the compression mechanism portions, there is formed a high pressure discharge chamber 5 (high pressure chamber).

The compression mechanism portion C has a cylinder 2 with a substantially elliptical inner periphery, and side blocks 3 and 4 are mounted to the end surfaces of the cylinder 2; further, inside the cylinder 2, a rotor 7 is horizontally installed, and the rotor 7 is supported so as to be rotatable through the intermediation of a rotor shaft 8 at the axial center thereof, a bearing 9 of the front side block 3, and a bearing (not shown) of the rear side block 4.

Figure 8:
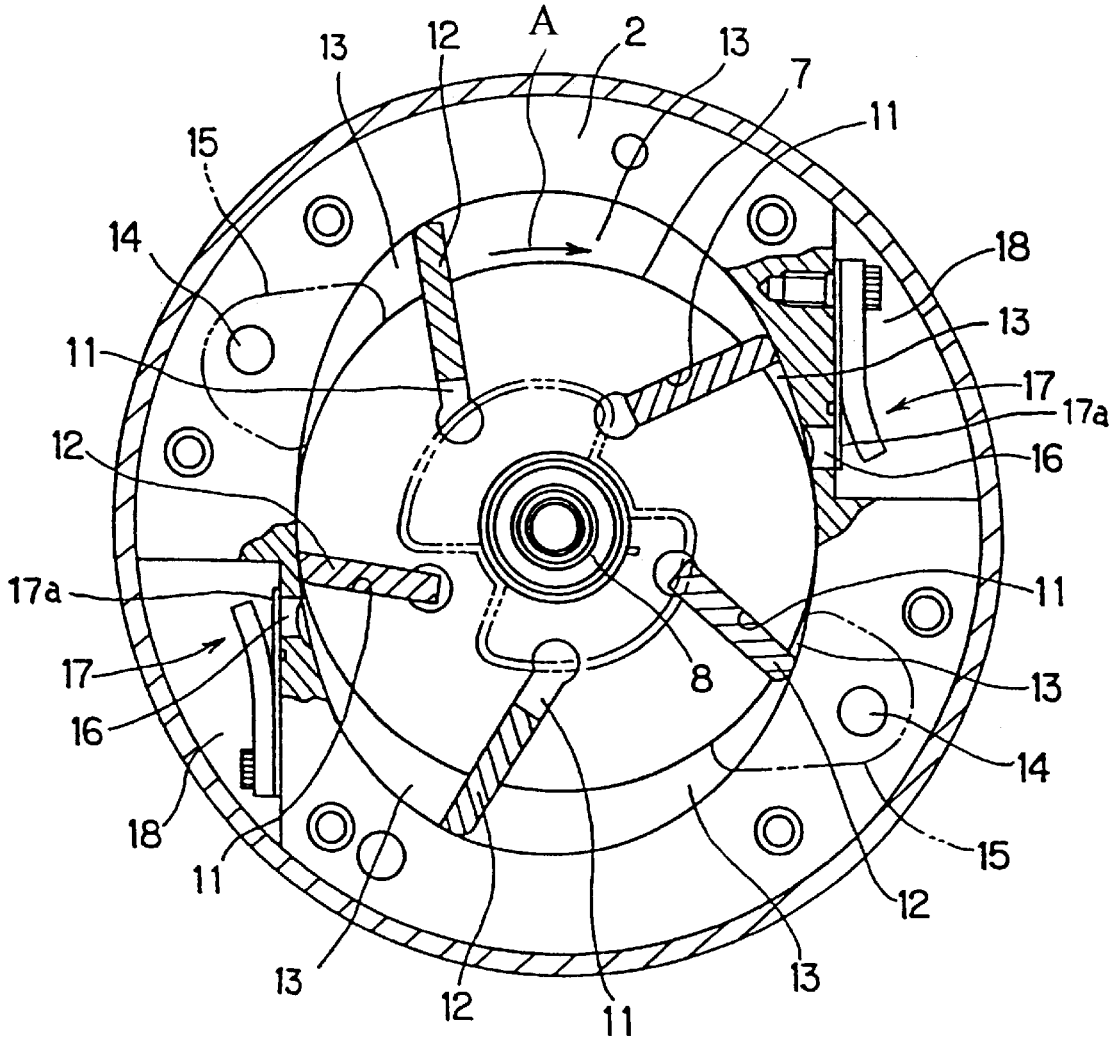
FIG. 8 is a sectional view taken along the line 8—8 of FIG. 7.

As shown in FIG. 8, in the rotor 7, there are radially formed five slit-like vane grooves 11, and in each of these vane grooves 11, a vane 12 is slidably arranged, each vane 12 being provided so as to be retractable from the outer peripheral surface of the rotor 7 toward the inner peripheral surface of the cylinder 2.

The inner space of the cylinder 2 is divided into a plurality of small chambers by the inner wall of the cylinder 2, the inner surfaces of the side blocks 3 and 4, the outer peripheral surface of the rotor 7, and the side surfaces of the forward end portions of the vanes 12, and the small chambers thus formed are compression chambers 13; the compression chambers 13 rotate in the direction of the arrow A in FIG. 8 to thereby continuously undergo variation in volume, and, through this variation in volume, they suck in and compress the refrigerant gas in the suction chamber 6 and discharge it to the discharge chamber 5 side.

That is, when the volume of the compression chambers 13 increases, the low pressure refrigerant gas in the suction chamber 6 is sucked in by the compression chambers 13 through suction passages 14 of the cylinder 2, etc. and suction holes 15 of the side blocks 3 and 4. Then, when the volume of the compression chambers 13 starts to be reduced, the refrigerant gas in the compression chambers 13 is compressed due to the volume reduction effect. Thereafter, when the volume of the compression chambers 13 approaches minimum, reed valves 17*a* of cylinder discharge holes 16 provided near the ellipsoid shorter-diameter portion of the cylinder are opened by the pressure of the compressed high pressure refrigerant gas, whereby the high pressure refrigerant gas in the compression chambers 13 passes through the cylinder discharge holes 16, discharge chambers 18 in the cylinder outer space, and a high pressure gas passage 19 before it is discharged to the discharge chamber 5 side and is temporarily stored in this discharge chamber 5.

That is, in the gas compressor of this embodiment, a series of passages consisting of the cylinder discharge holes 16, the discharge chambers 18 in the cylinder outer space, the high pressure gas passage 19, etc. establish communication between the compression mechanism portion C and the discharge chamber 5, and constitutes a discharge passage for guiding the refrigerant gas discharged from the compression chambers 13 of the compression mechanism portion C to the discharge chamber. An oil separator 20 is provided at the downstream end of this discharge passage.

Figure 1A:
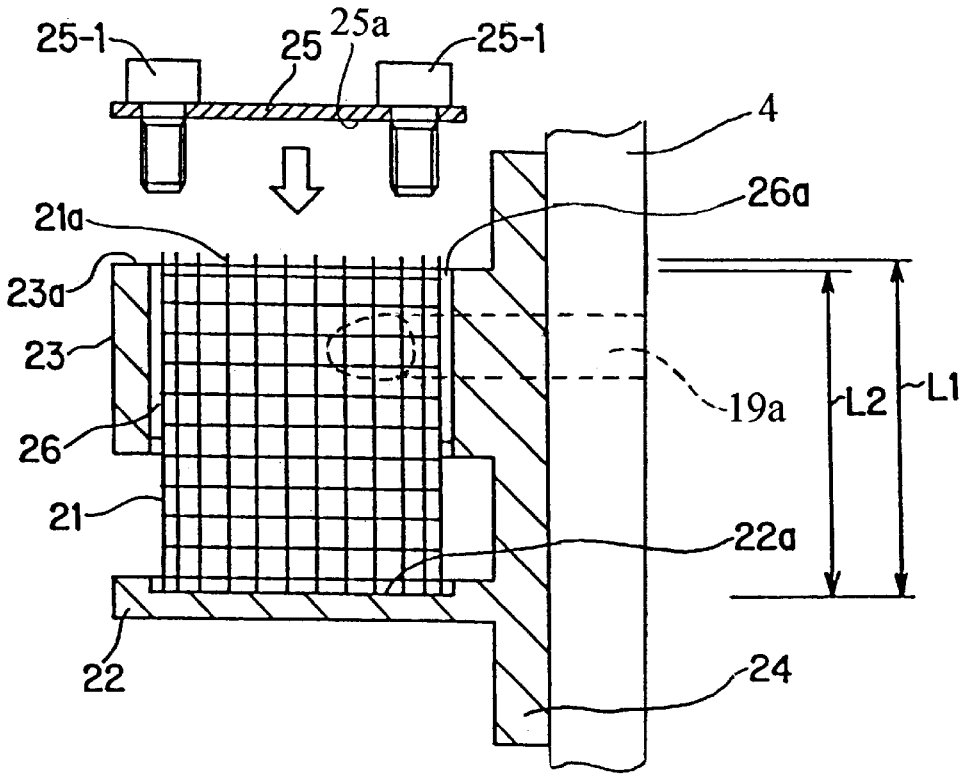
Figure 1B:
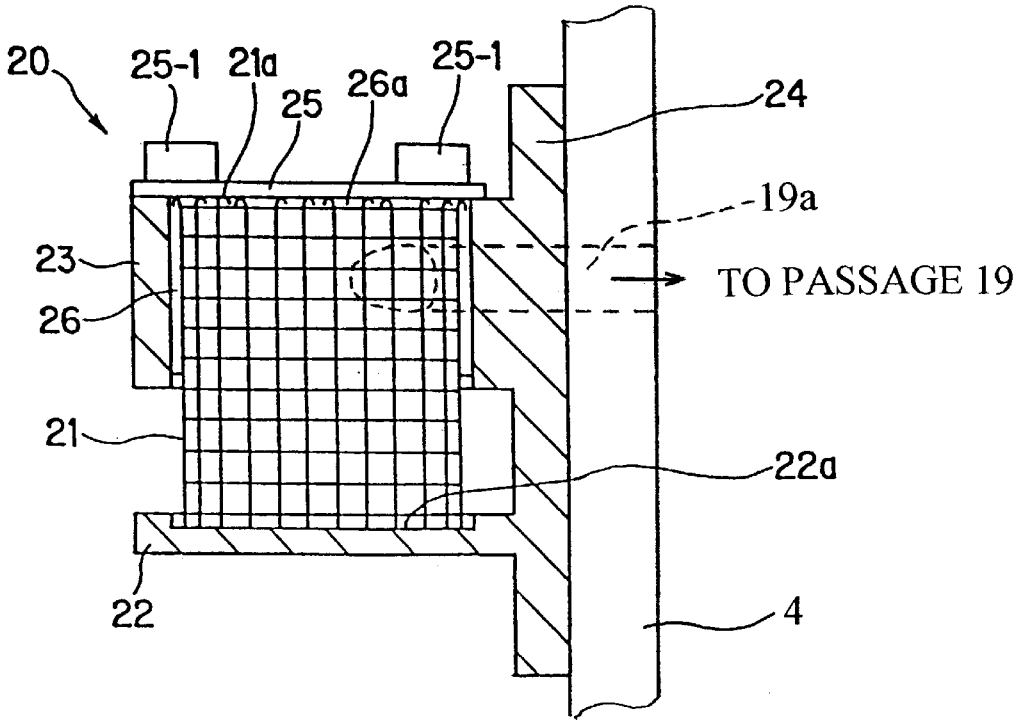
Figure 2A:
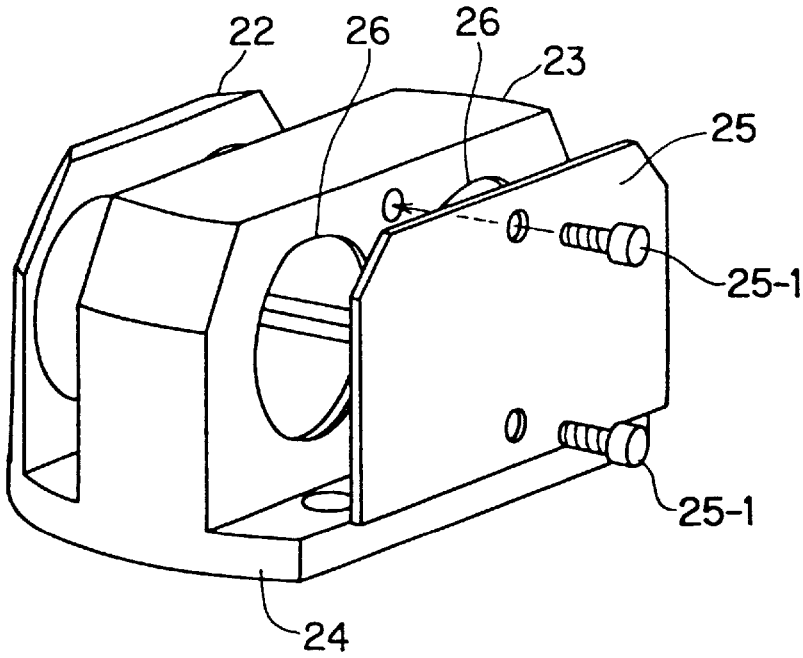
Figure 2B:
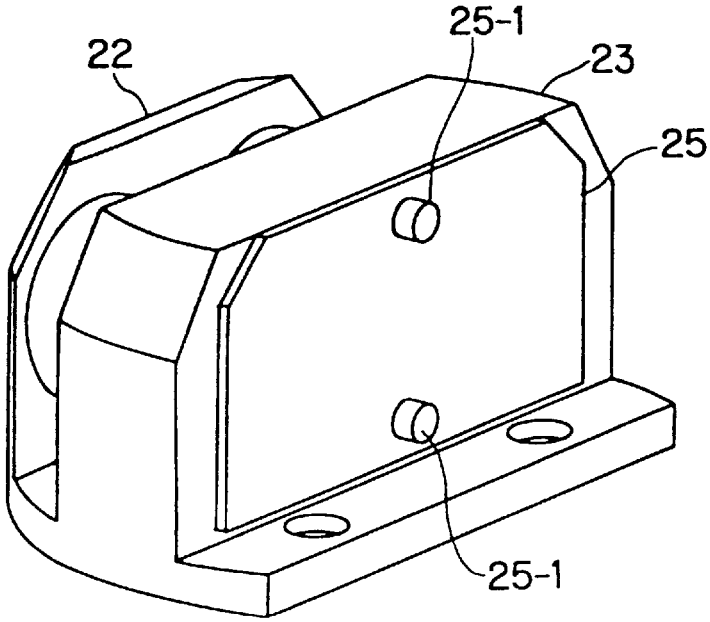

As shown in FIGS. 1A and 1B, the oil separator 20 is composed of an oil separation filter 21 and a mounting structure comprised of an abutment block portion 22, an outer peripheral block portion 23 and a pressurizing plate 25 for mounting the filter 21 in an elastically deformed state.

The oil separation filter 21 is arranged at the downstream end of such a discharge passage in the discharge chamber 5, and is of a wire net type using as the lattice-like member a wire net, which is spirally rolled into a cylinder.

Further, this oil separation filter 21 is attached to a filter accommodating hole 26 of the outer peripheral block portion 23, and its end portions are press-fixed by and between an abutment surface 22*a* of the abutment block portion 22 and an abutment surface 25*a* of the pressurizing plate 25.

That is, the outer peripheral block portion 23 has a filter accommodating hole 26 whose diameter is somewhat larger than that of the oil separation filter 21 (See FIG. 2), and the oil separation filter 21 is inserted into this filter accommodating hole 26 and secured therein; further, the abutment block portion 22 is formed such that the bottom end portion of the inserted oil separation filter 21 abuts it.

Further, in the case of this embodiment, the oil separation filter 21 is inserted into the filter accommodating hole 26 of the outer peripheral block portion 23 as described above, and when the bottom end portion of this oil separation filter 21 abuts the filter abutment surface 22*a* of the abutment block portion 22, the forward or top end portion 21*a* of the oil separation filter 21 protrudes from the filter accommodating hole 26 somewhat beyond the surface 23*a* of the outer peripheral block portion 23 as shown in FIG. 1A.

That is, the entire longitudinal length L1 of the oil separation filter 21 when in a non-deformed state is somewhat larger than the depth (filter accommodation depth) L2 as measured from the filter abutment surface 22*a* of the abutment block portion 22 against which the bottom portion of the oil separation filter 21 abuts to the inlet 26*a* of the filter accommodating hole 26. Stated otherwise, the length L1 of the filter when in the non-deformed state (FIG. 1A) is greater than the distance L2 between the abutment surfaces 22*a* and 25*a* when the pressurizing plate 25 is fastened to the outer peripheral block portion 23 (FIG. 1B).

Further, as shown in FIG. 1B, the forward or top end portion 21*a* of the oil separation filter 21, which protrudes as described above, is press-bent by the pressurizing plate 25 as the press-bending/crushing margin as shown in FIG. 1B, whereby, between the pressurizing plate 25 and the abutment block portion 22, the pressurizing plate 25 and the abutment block portion 22 press-fix the end portions of the oil separation filter 21 and maintain the oil separation filter 21 in a pressed, tightened state.

That is, as shown in FIG. 1A, the pressurizing plate 25 mounted and fixed to the outer peripheral block portion 23 by means of bolts 25-1 is put over the oil separation filter forward end portion 21*a* and due to the fastening force when fastening the pressurizing plate 25 to the outer peripheral block portion 23 by means of the bolts 25-1, a force press-bending the oil separation filter forward end portion 21*a* is applied to the oil separation filter 21 by the pressurizing plate 25. Then, due to this press-bending force, the oil separation filter forward end portion 21*a* is pressed toward the abutment block portion 22 and undergoes elastic deformation and plastic deformation to be press-bent as shown in FIG. 1B. By the elastic force due to the elastic deformation and the plastic deformation caused by excessive elastic deformation, the oil separation filter 21 is clamped so as to be strongly pressed against and fixed to the pressurizing plate 25, the abutment block portion 22, and the outer peripheral block portion 23.

As described above, this embodiment adopts an arrangement in which the oil separation filter 21 is elastically deformable and undergoes not only elastic deformation but also plastic deformation. This is due to the fact that an elastic deformation involving plastic deformation allows the elastic force to be exerted to the utmost. Thus, by forming the oil separation filter 21 of a material with high Young's modulus and appropriately setting the crushing margin of the oil separation filter 21, it is also possible to achieve an equivalent elastic force solely through elastic deformation involving no plastic deformation.

The abutment block portion 22 and the outer peripheral block portion 23 are provided integrally through the intermediation of a base block portion 24, and are mounted and fixed to the rear side block 4 constituting the wall surface of the discharge chamber 5.

Further, as shown in FIGS. 1A and 1B, provided in the base block portion 24 is a communication passage 19*a* establishing communicating connection between the high pressure gas passage 19 (See FIG. 7) and the filter accommodating hole 26, and high pressure refrigerant gas mixed with oil is introduced from the high pressure gas passage 19 to the oil separation filter 21 side through the communication passage 19*a*. The high pressure refrigerant gas and oil mixture thus introduced through the communication passage 19*a* into the filter accommodation hole 26 strikes against the wire net constituting the oil separation filter 21, and whirls circumferentially inside the oil separation filter 21.

At this time, also in the gas compressor of this embodiment, a force causing the oil separation filter 21 to vibrate is generated by the high speed gas flow of pulsating high pressure refrigerant gas; however, since this oil separation filter 21 is strongly pressed against and fixed to the abutment block portion 22 and the outer peripheral block portion 23 as a result of the above-described elastic deformation, vibration of the oil separation filter 21 is prevented. Thus, the problem due to the vibration of this type of oil separation filter 21, that is, the so-called fretting wear of the wire net caused by the constituent wire materials (wires) constituting the oil separation filter 21 rubbing each other or the wire net and the support member in contact therewith rubbing each other, is substantially reduced, thereby improving the durability of the gas compressor.

Also in the gas compressor of this embodiment, oil is contained as a mist in the high pressure refrigerant gas immediately after its discharge from the compression mechanism portion C; due to the striking of the high pressure refrigerant gas against the oil separation filter 21 and the centrifugal force generated by the whirling of the high pressure refrigerant gas inside the oil separation filter 21, the oil ingredient in the high pressure refrigerant gas is separated, and drips into the oil sump 28 at the bottom of the discharge chamber 5 to be stored there.

While in the above embodiment a construction is adopted in which the oil separation filter forward end portion 21*a* is press-bent by the pressurizing plate 25, not all the portions of the oil separation filter forward end portion 21*a* are necessarily bent so as to be directed in the same direction when the oil separation filter forward end portion 21*a* is press-bent. For example, it can happen that a part of the oil separation filter forward end portion 21*a* is bent so as to fall on the filter outer side. In this case, the outwardly bent portion of the oil separation filter forward end portion 21*a* can stick out and get caught between the pressurizing plate 25 and the outer peripheral block portion 23, making it difficult to mount and fix the pressurizing plate 25 to the outer peripheral block portion 23 correctly.

Figure 3:
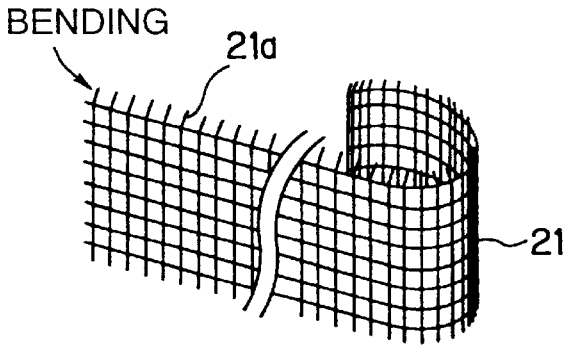
FIG. 3 is an explanatory diagram showing another embodiment of the present invention, showing how the oil separation filter forward end portion is previously bent.

In order to prevent the oil separation filter forward end portion 21*a* from thus sticking out, it is desirable, as shown in FIG. 3, for the oil separation filter forward end portion 21*a* to be bent previously and positively in a fixed direction, more specifically, toward the filter inner side, before being press-bent by the pressurizing plate 25.

When this construction is adopted, all the portions of the oil separation filter forward end portion 21*a* are press-bent in the same direction in conformity with the direction of the previous bending, that is, toward the filter inner side by the pressurizing plate 25, so that a superior operability is achieved in fixing the bending direction, and there is no danger of the bent oil separation filter forward end portion

21*a* sticking out and getting caught between the pressurizing plate 25 and the outer peripheral block portion 23, whereby it is possible to correctly mount and fix the pressurizing plate 25 to the outer peripheral block portion 23.

In the above construction, the pre-bending amount of the oil separation filter forward end portion 21*a* is less than the amount by which the oil separation filter forward end portion 21*a* is press-bent by the pressurizing plate 25 because if the latter is larger than that, the press-bending of the oil separation filter forward end portion 21*a* by the pressurizing plate 25 is impossible, and the above effect of this press-bending, that is, the effect of firmly fixing the oil separation filter 21 through elastic deformation, cannot be obtained.

Figure 4:
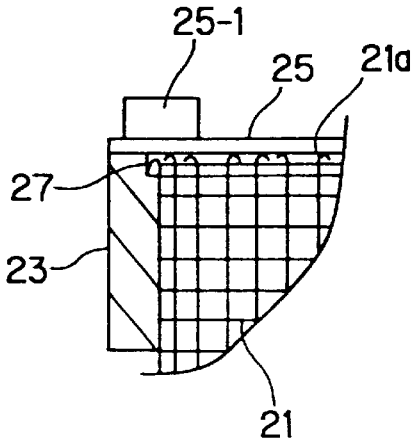
FIG. 4 is an explanatory diagram showing another embodiment of the present invention, showing a clearance groove in which the oil separation filter forward end portion enters when bent.

Further, regarding the means for preventing the oil separation filter forward end portion 21*a* from sticking out, it is also possible to adopt a sticking-out preventing structure as shown in FIG. 4. In the sticking-out preventing structure shown in the drawing, a clearance groove 27 is annularly formed in the inner peripheral surface of the filter accommodating hole 26. In the case of this structure, when the oil separation filter forward end portion 21*a* is press-bent on the filter outer side, the press-bent portion enters this clearance groove 27.

Thus, like the structure in which the oil separation filter forward end portion 21*a* is bent previously and positively, the sticking-out preventing structure of FIG. 4 makes it possible to effectively prevent the bent oil separation filter forward end portion 21*a* from sticking out and getting caught between the pressurizing plate 25 and the outer peripheral block portion 23, making it possible to mount and fix the pressurizing plate 25 to the outer peripheral block portion 23 correctly.

By adopting both the oil separation filter forward end portion 21*a* bending structure shown in FIG. 3 and the clearance groove 27 shown in FIG. 4, it is possible to more effectively prevent the oil separation filter forward end portion 21*a* from sticking out.

Figure 5:
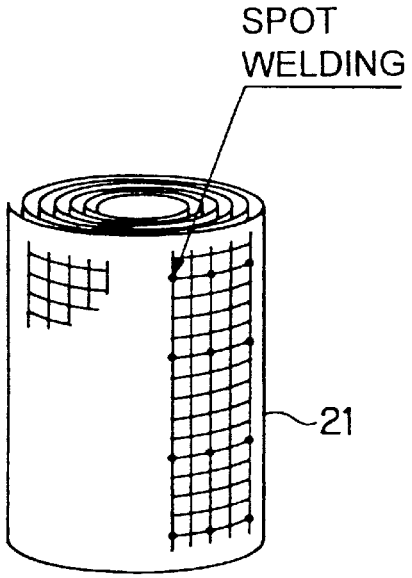
FIG. 5 is an explanatory diagram showing another embodiment of the present invention, showing the spot-welded portions when the oil separation filter is formed of a wire net.

In the above-described embodiment, the wire net type oil separation filter 21 is adopted; when using this wire net type oil separation filter 21, it is desirable to perform spot welding for fusing connection on the regions where the constituent wire materials (wires) of the wire net intersect each other, as shown in FIG. 5. This spot welding is performed for the purpose of preventing fretting wear mainly due to vibration between the constituent wire materials of the wire net. Thus, from the viewpoint of the purpose of the spot welding, it is desirable to increase the number of spot welding points in the regions especially subject to large vibration, e.g., the region where the high speed gas flow of high pressure refrigerant gas first strikes directly.

Figure 6A:
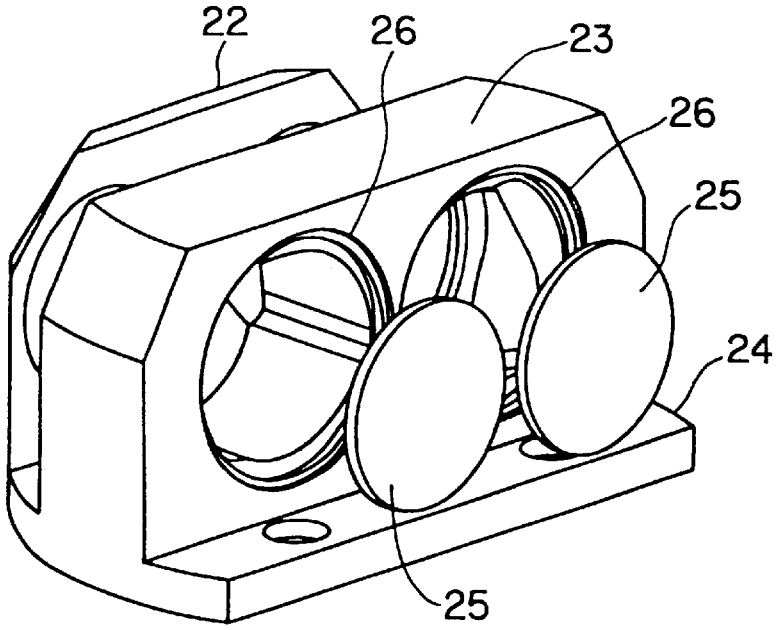
Figure 6B:
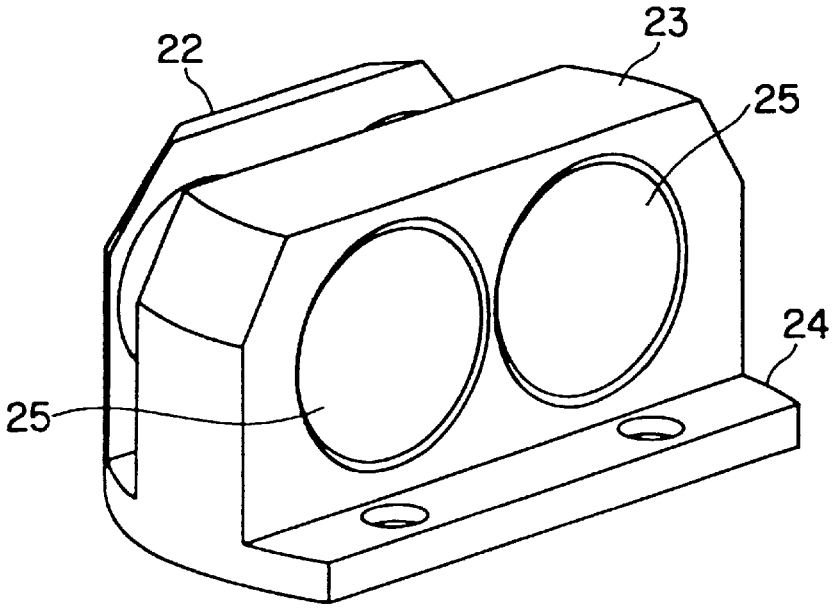

In the above-described embodiment the oil separation filter forward end portion 21*a* is press-bent by the fastening force when fastening the pressurizing plate 25 to the outer peripheral block portion 23 by means of the bolts 25-1; instead, it is also possible, as shown in FIG. 6, to fix the pressurizing plates 25 to the filter accommodating holes 26 of the outer peripheral block portion 23 by caulking, and to press-bent the oil separation filter forward end portion 21*a* by the caulking force.

Further, apart from the wire net, the lattice-like member constituting the oil separation filter 21 may also consist, for example, of expanded metal; in the case of expanded metal, a thin plate with fine alternate slits is expanded into a lattice-like form like a wire net; the oil separation filter 21 may be formed by shaping this expanded metal into a cylinder.

As described above, in the gas compressor of the present invention, there is provided pressing means for press-fixing the end portions of the oil separation filter, and the entire oil separation filter is firmly fixed by the pressing force when the pressing means press-fixes the end portions of the oil separation filter. Thus, it is possible to effectively prevent a phenomenon of the oil separation filter being vibrated due to the high speed gas flow of the pulsating high pressure refrigerant gas, and it is possible to substantially mitigate the problem due to vibration of this type of oil separation filter, e.g., fretting wear of the wire net constituting the oil separation filter, making it possible, for example, to improve the durability of the gas compressor.

What is claimed is:

1. A gas compressor comprising: a compression mechanism for compressing a mixture of low pressure refrigerant gas and oil and discharging a pulsating mixture of high pressure refrigerant gas and oil; a discharge passage for delivering the discharged pulsating mixture of high pressure refrigerant gas and oil to a discharge chamber; and an oil separator disposed in the discharge chamber in communication with a downstream end of the discharge passage for separating the oil from the pulsating mixture of refrigerant gas and oil, the oil separator comprising an elastically deformable filter positioned so that the pulsating mixture of high pressure refrigerant gas and oil strike the filter and flow therethrough, and a mounting structure for elastically deforming the filter and mounting and maintaining the deformed filter in an elastically deformed state to suppress vibration thereof caused by the pulsating mixture of high pressure refrigerant gas and oil striking the filter.

2. A gas compressor according to claim 1; wherein the mounting structure includes two opposed, spaced-apart abutment surfaces, the elastically deformable filter being pressed between the two abutment surfaces to place the filter in an elastically deformed state.

3. A gas compressor according to claim 2; wherein the elastically deformable filter has a generally cylindrical shape having opposite end portions, the opposite end portions being in contact with respective ones of the abutment surfaces.

4. A gas compressor according to claim 3; wherein the elastically deformable filter is comprised of wire net.

5. A gas compressor according to claim 3; wherein the elastically deformable filter is comprised of expanded metal.

6. A gas compressor according to claim 3; wherein the length of the elastically deformable filter, when in a non-deformed state, is greater than the distance between the two spaced-apart abutment surfaces so that when the filter is pressed between the two abutment surfaces, one end portion of the filter undergoes elastic bending deformation.

7. A gas compressor according to claim 6; wherein the one end portion of the filter that undergoes elastic bending deformation is partly pre-bent prior to being pressed between the two abutment surfaces and undergoes further elastic bending deformation when pressed between the two abutment surfaces.

8. A gas compressor according to claim 7; wherein the one end portion of the filter is pre-bent in an inward direction toward the inside of the filter.

9. A gas compressor according to claim 1; wherein the mounting structure comprises an abutment block portion having an abutment surface on which a bottom end portion of the elastically deformable filter abuts, a peripheral block portion having an accommodating hole into which the filter is inserted, and a pressurizing plate having an abutment surface, the pressurizing plate being disposed over a top end portion of the filter so that the abutment surface thereof abuts the top end portion of the filter and being fastened to the peripheral block portion to compress the filter between the two abutment surfaces to thereby place the filter in the elastically deformed state.

10. A gas compressor according to claim 9; wherein an upper end portion of the peripheral block portion has an annular groove for receiving therein a bent top end portion of the filter which is elastically bent when the filter is placed in an elastically deformed state.

11. A gas compressor according to claim 9; wherein the pressurizing plate is removably fastened to the peripheral block portion.

12. A gas compressor comprising:

a compression mechanism portion which sucks in, compresses, and discharges refrigerant gas;

a discharge member for temporarily storing the refrigerant gas discharged from the compression mechanism portion;

a discharge passage which communicates the compression mechanism portion with the discharge chamber and which guides high pressure refrigerant gas discharged from the compression mechanism portion to the discharge chamber;

an oil separation filter arranged in the discharge chamber and at a downstream end of the discharge passage and which is formed by shaping a lattice-like member into a cylindrical configuration having opposite end portions;

pressing means for pressing the oil separation filter at opposite end portions thereof to elastically deform the oil separation filter sufficiently to suppress vibration thereof caused by pulsating high speed flow of high pressure refrigerant gas; and an oil sump formed at a bottom of the discharge chamber for storing the oil separated by the oil separation filter.

13. A gas compressor according to claim 12, wherein the oil separation filter is comprised of a wire net.

14. A gas compressor according to claim 12, wherein the oil separation filter is formed of expanded metal.

15. A gas compressor according to claim 12, wherein the pressing means comprises an abutment block portion against which a bottom end portion of the oil separation filter abuts, an outer peripheral block portion having a filter accommodating hole into which the oil separation filter is inserted, and a pressurizing plate disposed over a forward end portion of the oil separation filter and mounted and fixed to the outer peripheral block portion;

wherein the forward end portion of the oil separation filter protrudes from a forward end of the filter accommodating hole, and the protruding forward end portion of the oil separation filter is pressurized and bent by the pressurizing plate to undergo elastic deformation.

16. A gas compressor according to claim 15, wherein there is provided in the inner surface of the filter accommodating hole a clearance groove which allows entrance of the forward end portion of the oil separation filter which is previously bent toward the outer side of the filter.

17. A gas compressor according to claim 15, wherein the forward end portion of the oil separation filter is previously bent in a fixed direction by a bending amount smaller than a press-bending amount before being press-bent by the pressurizing plate.

18. A gas compressor according to claim 17, wherein the direction in which the forward end portion of the oil separation filter is previously bent is toward the inner side of the filter.

19. A gas compressor according to claim 12, wherein the oil separation filter comprises a wire net having crossing wires that are spot-welded at points where the wires cross one another.

20. A gas compressor according to claim 19, wherein the number of points where the crossing wires are spot-welded is greatest in the region where the pulsating high speed flow of high pressure refrigerant gas directly strikes the oil separation filter.

* * * * *